United States Patent [19]

Van de Sande et al.

[11] Patent Number: 4,483,915

[45] Date of Patent: Nov. 20, 1984

[54] AZO DYE RELEASING COMPOUNDS WITH HYDROLYTIC REMOVABLE GROUP FOR DYE DIFFUSION TRANSFER PROCESS

[75] Inventors: Christian C. Van de Sande, Belsele; Armand M. Van den Bergh, Berchem; Wilhelmus Janssens, Aarschot, all of Belgium

[73] Assignee: Agfa-Gevaert, N. V., Mortsel, Belgium

[21] Appl. No.: 556,197

[22] Filed: Nov. 29, 1983

[30] Foreign Application Priority Data

Dec. 7, 1982 [GB] United Kingdom ..... 8234827

[51] Int. Cl.[3] ..... G03C 1/10; G03C 1/40; G03C 5/54

[52] U.S. Cl. ..... 430/223; 430/561; 430/562; 430/958

[58] Field of Search ..... 430/223, 225, 561, 562, 430/958

[56] References Cited

U.S. PATENT DOCUMENTS

| | | | |
|---|---|---|---|
| 3,295,973 | 1/1967 | Blout et al. | 430/225 |
| 4,139,379 | 2/1979 | Chasman et al. | 430/223 |
| 4,232,107 | 11/1980 | Janssens | 430/223 |

*Primary Examiner*—Richard L. Schilling
*Attorney, Agent, or Firm*—A. W. Breiner

[57] ABSTRACT

A photographic silver halide material comprises a shifted dye compound capable of releasing a dye moiety, characterized in that said compound corresponds in reduced state to general formula (1) and in oxidized state to general formula (2):

$$A^1—L—P \quad (1)$$

$$A^2—L—P \quad (2)$$

wherein:

$A^1$ represents a hydroquinonyl group including a substituted hydroquinonyl group, or such group forming part of a fused ring system, $A^2$ represents a quinonyl group including a substituted quinonyl group, or such group forming part of a fused ring system, L represents a bivalent group which undergoes a cleavage under hydrolytic alkaline conditions when the compound is in reduced state corresponding to formula (1), P represents an organic dye moiety incorporating an azo chromophoric group —N=N— linked through a conjugated bond system to an electron-withdrawing group being monoester oxalyl group $$-O-\underset{\underset{O}{\|}}{C}-\underset{\underset{O}{\|}}{C}-OR,$$

wherein R represents an organic group, that can be introduced by esterification of a carboxylic acid group, said monoester oxalyl group being removable by hydrolysis resulting in a residual auxochromic hydroxyl (—OH) group.

10 Claims, 2 Drawing Figures

Figure 1:
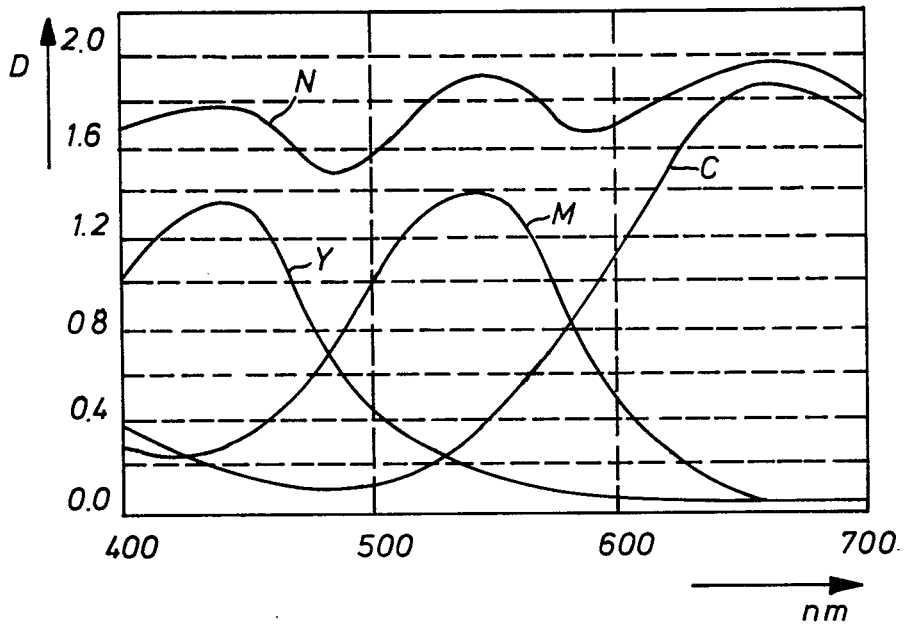

AZO DYE RELEASING COMPOUNDS WITH HYDROLYTIC REMOVABLE GROUP FOR DYE DIFFUSION TRANSFER PROCESS

The present invention relates to new dye releasing compounds and their use in photographic silver halide colour materials and a process for the production of colour images by dye diffusion transfer. More particularly the present invention relates to photographic silver halide colour materials in which favourable interimage effects result in an improved colour saturation of a multicolour print.

The production of a dye image by image-wise modulated diffusion transfer of a dye with a photographic silver halide emulsion material can be carried out in a number of ways. The dye diffusion transfer systems operating with photosensitive silver halide are all based on the same principle, viz. the alteration in the mobility of a dye or of a molecule part being a dye is controlled by the image-wise development of silver halide to silver.

For that purpose ballasted dye-providing chemicals have been developed one type of which is negative working in that they yield negative colour transfer images in combination with negative working silver halide emulsions and the other type is positive (also called reversal) working in that they yield positive colour transfer images in combination with negative working silver halide emulsions.

According to a first colour imaging system for producing colour images by diffusion transfer, silver halide emulsion layers are used which include dye developers having a hydroquinone structure permanently attached to a coloured substituent i.e. either a yellow, magenta or cyan coloured substituent for subtractive multicolour image formation.

In the development of the exposed silver halide the hydroquinone-dye developer is oxidized and thereby transformed into a non-ionizable immoble quinone. Unoxidized hydroquinone-dye is transferred by diffusion to a receptor element. Examples of these dye developers and more details about said system are described in U.S. Pat. Nos. 2,983,606 of Howard G. Rogers, issued May 9, 1961 and 3,362,819 of Edwin H. Land, issued Jan. 9, 1968.

According to a second colour diffusion transfer system a positive dye image is produced by a diffusible dye which is set free image-wise from a silver halide emulsion layer material from a particular initially immobile image-dye providing compound in reduced state. Examples of such system providing in a receptor element positive diffusion transfer dye images with the aid of image-wise exposed and developed silver halide are described, e.g., in the U.S. Pat. Nos. 4,139,379 of Richard A. Chasman, Richard P. Dunlap and Gerald C. Hinshaw and 4,139,389 of Jerald C. Hinshaw and Richard P. Henzel, both issued Feb. 13, 1979, in the United Kingdom Patent Specification No. 1,593,669 filed Nov. 30, 1977 by Agfa-Gevaert A. G., the published European Patent Applications 0 004 399 filed Mar. 9, 1979 and 00 38 092 filed Mar. 18, 1981 both by Agfa-Gevaert N. V.

In the production of colour prints in the classical silver halide photography, using colour couplers forming dyes upon coupling with oxidized developing agent, interlayer effects also called interimage effects are used to obtain masking of side absorptions and to influence the development of components in adjacent layers to some extent. So, the amount of dye formed in an area of a layer depends also on the degree of exposure of the other layers in that area [ref. T. H. James, The Theory of the Photographic Process, 4th ed. Macmillan Publishing Co., Inc. New York (1977) p.533].

In subtractive colour photography a white area of the original will be represented by the absence of any dye, whereas a black will be represented by the superposition of yellow, magenta and cyan dye. Beer's law is valid for the dyes of that system. This law states that the optical density at any wavelength is proportional to the concentration of the dye, which means in dye diffusion transfer proportional to the amount of dye superposed in the receptor element. In other words, the analytical spectral density of the composite colour image is equal to the sum of the spectral densities of the compound light-absorbers i.e. the individual dyes at any wavelength.

Graphs of the distribution of spectral density, i.e. spectral density D versus wavelength in nm of cyan (C), magenta (M) and yellow (Y) dyes for a hypothetical colour film and of the composite absorption (N) at any wavelength of the visible spectrum are given in FIG. 1.

Figure 2:
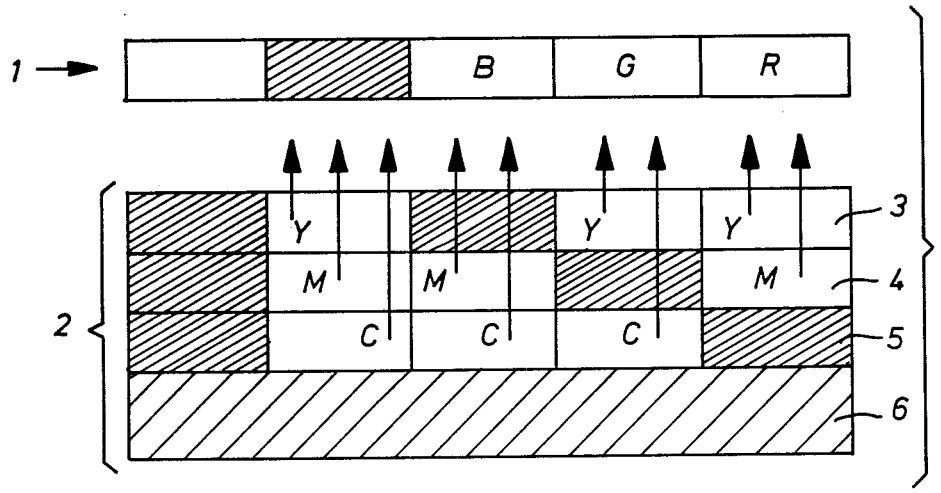

FIG. 2 serves to explain the working mechanism of a dye diffusion transfer material operating as explained in said first and second mentioned colour imaging systems.

From FIG. 1 it can be learned that as a result of the side absorptions of the dyes the composite light absorption represented by curve N is at every wavelength higher than the light absorption of the individual dyes (C), (M) and (Y) at that wavelength.

Since the spectral densities of the individual dyes over the whole visible spectrum are additive, the spectral integral density $D_N$ of a black image area can be written as the sum of the component spectral densities $$D_N = D_C + D_M + D_Y$$

i.e. the sum of the cyan density, magenta density and yellow density.

When in the production of a black image area more of each individual dye is formed or deposited than in an image area of a one third spectrum (primary) colour which is red, green or yellow (in the subtractive system red is built up by superposition of yellow and magenta dye, green by superposition of cyan and yellow dye and blue by superposition of magenta and cyan dye) the appareance of the final multicolour image will lack brightness i.e. a colour image of poor colour saturation will be obtained. Such result is due to a so-called negative interimage effect.

If on the contrary due to interimage effects one of the individual dyes will be formed or deposited in a one third spectrum colour area in an amount larger than in a black area a colour image of increased colour saturation and more bright appearance will be obtained. This result is due to a so-called positive interimage effect.

Considering the above mentioned first imaging system we may conclude that due to the inherent properties of said system a negative interimage effect is produced because individual dye deposition in correspondence with one third spectrum colour areas will be smaller than individual dye deposition in a neutral grey area. Such is explained with the aid of FIG. 2 for the deposition of cyan dye used in building, as a one third spectrum colour area, a green area and a black area respectively.

A more detailed structure of such material operating according to said first imaging system is given in the book "The Theory of the Photographic Process", 4th ed. Macmillan Publishing Company Inc. New York (1977) under the heading "Image-transfer processes" by L. J. Fleckenstein p.367.

In said first imaging system element 1 of FIG. 2 represents a multicolour original in which the letters B, G and R represent blue, green and red image areas, the black image area is hatched and the colourless image area is left blank. Element 2 represents a multicolour photographic element having three differently spectrally sensitive negative working silver halide emulsion layers viz. a blue-sensitive layer 3, a green-sensitive layer 4 and a red-sensitive layer 5 and a support 6. The blue-, green-, and red-sensitive layers contain respectively a yellow (Y), magenta (M) and cyan (C) dye-developer. Where the photographic material 2 is not struck by light, i.e. in the area corresponding with the black image area of the original 1, in the development no dye-developer is oxidized in any of the silver halide emulsion layers 3, 4 and 5 corresponding with said black area and these dye-developers diffuse in an equal degree to a receptor material (not shown in the drawing). In the only green-light exposed area magenta dye is not released since in the green-sensitive layer 4 magenta dye-developer is oxidized by exposed silver halide and in oxidized form cannot diffuse any longer. In the non-exposed area of the blue- and red-sensitive layers 3 and 5 corresponding with the green image area of the original 1 non-oxidized yellow and cyan dye-developer diffuse. On diffusing through the green-sensitive layer 4 the cyan dye-developer encounters developable silver halide and a part of the cyan dye-developer becomes oxidized and immobilized therein, hereby leaving an equivalent amount of magenta dye-developer still in diffusible state. Hereby the green in the receptor material obtains a lower density whereby the colour image brilliance is reduced. So, due to unwanted interimage effects between the different superposed dye yielding layers a negative influence on colour brilliance is obtained. With regard to FIG. 1 such means that one third spectrum colours are built up by a smaller amount of individual dyes than is present in a black area. As a consequence thereof, the neutral line N of a thus reproduced black area lies higher than a neutral line N that is obtained by addition of densities of each less effectively reproduced one third spectrum colour area.

The inherent properties of the second colour imaging system referred to hereinbefore offer colour prints wherein the amount of released dye in correspondence with a black area and a one third spectrum primary colour area respectively are proportionally the same since in that system released dyes do not chemically interact in neighbouring layers. The interimage effect is thereby actually zero.

As explained in the published European Patent Specification 0,004,399 the released dye moiety is a dye or a shifted dye. The dyes include e.g. azo dyes, azomethine dyes, anthraquinone dyes, alizarin dyes, merocyanine dyes, quinoline dyes and cyanine dyes. The shifted dyes as mentioned e.g. in the U.S. Pat. No. 3,260,597 include those compounds wherein the light absorption characteristics are shifted hypsochromically or bathochromically when subjected to a different environment such as a change of the pKa of the compound, or removal of a group such as a hydrolyzable acyl group connected to an atom of the chromophoric system and affecting the chromophore resonance structure. The shifted dyes can be incorporated directly in a silver halide emulsion layer or even on the exposure side thereof without substantial reduction of the imagewise modulated light exposure dose. After exposure, the dye is shifted to the appropriate colour, for example by hydrolytic removal of said acyl group.

It has now been established experimentally by us that acylation of a hydroxyl group serving as an auxochrome to the chromophore azo-group (—N=N—), makes the latter group susceptible to reduction with a corresponding loss in colour density.

It is one of the objects of the present invention to take profit of that effect with respect to the obtaining of a positive interimage effect in a dye diffusion transfer process wherein a dye is released from dye releasing compounds in reduced state.

It is more particularly an object of the present invention to provide new dye releasing compounds and a photographic material wherein said compounds serve for improving the colour brilliance of dye images obtained by a dye diffusion transfer process.

Other objects and advantages of the present invention will be clear from the further description.

According to the present invention compounds releasing in reduced state a dye under alkaline conditions are provided which compounds are characterized by the general formula (1) in reduced state and by the general formula (2) in oxidized state:

$$A^1—L—P \quad (1)$$

$$A^2—L—P \quad (2)$$

wherein:

$A^1$ represents a hydroquinonyl group including a substituted hydroquinonyl group, or such group forming part of a fused ring system, $A^2$ represents a quinonyl group including a substituted quinonyl group, or such group forming part of a fused ring system, L represents a bivalent group which undergoes a cleavage under hydrolytic alkaline conditions when the compound is in reduced state corresponding to formula (1), such group being e.g.

$$-\overset{R'}{\overset{|}{N}}-\overset{O}{\overset{\|}{C}}- \text{ or } -\overset{R'}{\overset{|}{CH}}-SO_2-,$$

wherein R' is hydrogen or a hydrocarbon group e.g. alkyl or phenyl,

P represents an organic dye moiety incorporating an azo chromophoric group —N=N— linked through a conjugated bond system to an electron-withdrawing group being a monoester oxalyl group $$-O-\underset{\underset{O}{\|}}{C}-\underset{\underset{O}{\|}}{C}-OR,$$

wherein R represents an organic group that can be introduced by esterification of a carboxylic acid group, e.g. a hydrocarbon group including a substituted hydrocarbon group, e.g. an alkyl or an aryl group, preferably a $C_1$–$C_4$ alkyl group, said monoester oxalyl group being removable by hydrolysis resulting in a residual auxochromic hydroxyl (—OH) group.

Examples of compounds according to one of the above general formulae (1) or (2) but wherein said hydroxyl group is not acylated or an other acyl group than

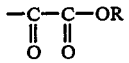

is present, e.g. a

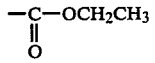

group, are described e.g. in U.S. Pat. No. 3,980,479 of Donald Lee Fields, Richard Paul Henzel, Philip Thiam Shin Lau and Richard Allan Chasman, issued Sept. 14, 1979, U.S. Pat. No. 4,139,379 of Richard A. Chasman, Richard P. Dunlap, Jerald C. Hinshaw, issued Feb. 13, 1979, in the United Kingdom Patent Specification No. 1,593,669 filed by Agfa-Gevaert A. G., Nov. 30, 1977 and in the published European Patent Applications 0 004 399 and 00 38 092 filed both by Agfa-Gevaert N. V. on Mar. 9, 1979 and Mar. 18, 1981 respectively.

The dye release by reaction of compounds according to the general formula (2) is exemplified by the following reaction schemes described in the above prior art.

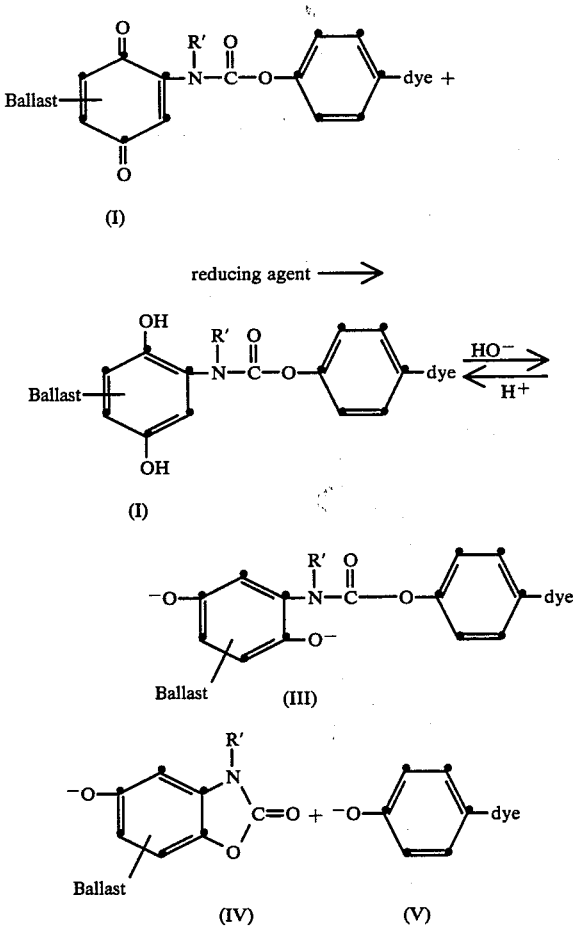

The dye compound (V) is released where the nucleophilic group, here the hydroxyl group of the hydroquinone, can attack the carbamate ester linkage. However, when the nucleophilic group is oxidized, which is the case in the quinone form, nucleophilic displacement is impossible. The compounds of the above formula (I) are referred to in said U.S. Pat. No. 4,139,379 as BEND-compounds wherein BEND is an acronym for Ballasted Electron-accepting Nucleophilic Displacement.

As is known in the art, "Ballast" stands for ballasting group, which group makes the molecule immobile. Thus, said BEND-compounds used according to the present invention are ballasted compounds capable of undergoing an electro-accepting nucleophilic displacement reaction separating hereby in alkaline medium a diffusible azo dye.

Other particularly useful compounds releasing a dye subsequent to reduction through the action of alkali ($HO^-$) are split into a ballasted quinone methide compound and a diffusible compound containing a dye moiety.

The image-wise dye release from such compounds described in the last mentioned published European Patent Applications proceeds according to the following reaction mechanism illustrated with simplified general formulae of quinonoid compounds $(I)^1$:

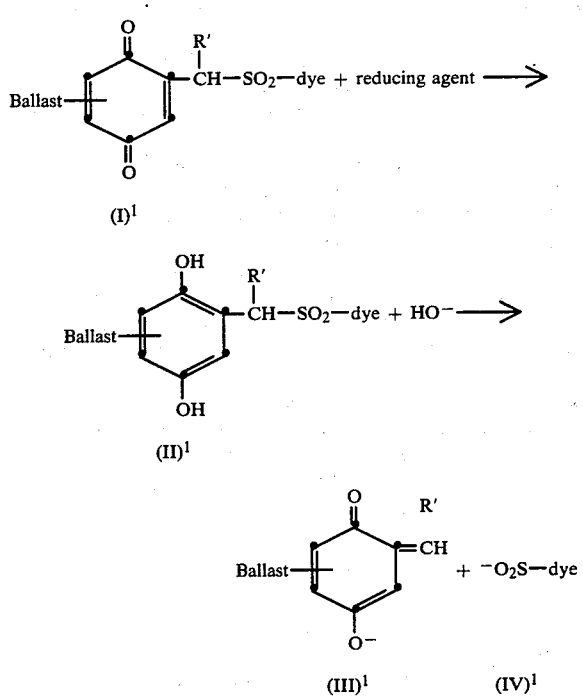

In said formula $(I)^1$ "Ballast" may be present in the R'-group instead of on the quinonolyl nucleus and includes a long chain (e.g. a $C_{12}$–$C_{20}$) alkyl group.

The above BEND compounds and quinone-methide-yielding compounds belong to the class of compounds the hydrolysability of which is increased by reduction and are called IHR-compounds. The IHR-compounds applied in the present invention release in reduced state under alkaline conditions a diffusible azo dye.

In said general formulae (I) and $(I)^1$ the diffusible residue is the group P of our general formula (1) and (2) and L in said general formulae (1) and (2) is consequently:

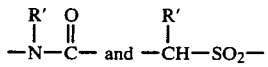

wherein R' is hydrogen, or a hydrocarbon group.

With regard to terminology used in the description of the present invention we like to point out that the term "non-diffusing" used herein has the meaning commonly applied to the term in photography and denotes materials that in any practical application do not migrate or wander through organic colloid layers, e.g. gelatin, when permeated with an alkaline medium. The same meaning is to be attached to the term "immobile".

The term "diffusible" as applied to the materials of this invention has the converse meaning and denotes materials having the property of diffusing effectively through the colloid layers of the photographic elements in an alkaline medium. "Mobile" has the same meaning.

By "operable contact" is meant that for producing diffusion transfer of an image-wise released dye or dye precursor compound on applying an alkaline processing liquid in the presence of a photographic silver halide developing agent, said compound releasing a dye or dye precursor can come into chemically reactive contact with unoxidized reducing agent in an amount that is controlled by the image-wise developable silver halide of an image-wise photo-exposed silver halide emulsion layer.

The term "negative working emulsion layer" is reserved to silver halide emulsion layers which yield on development a visible silver image in correspondence with the exposed areas.

According to the present invention a photographic material is provided comprising a support carrying at least one unexposed alkali-permeable silver halide hydrophilic colloid emulsion layer containing, or being in operable contact with, a compound which is immobile in an alkali-permeable colloid medium when contacted with an alkaline liquid and which is capable of being reduced by a silver halide developing agent at a rate slower than that of the said silver halide when in developable state, and when in reduced state is capable of releasing a dye moiety, characterised in that said compound corresponds in reduced state to general formula (1) and in oxidized state to general formula (2):

$$A^1—L—P \quad (1)$$

$$A^2—L—P \quad (2)$$

wherein $A^1$, $A^2$, L, and P are defined as described hereinbefore.

For the purpose of multicolor image production the photographic material contains a support carrying red-, green- and blue-sensitive silver halide emulsion layers, each of said emulsion layers containing said compound that is initially immobile in an alkali-permeable colloid medium, and which is capable of releasing a cyan, magenta and yellow dye, respectively.

The positive interimage effect obtained with a said photographic multicolor material according to the present invention is explained likewise by means of FIG. 2. In the schematic drawing element 1 represents a multicolour original in which the letters B, G and R represent blue, green and red image areas, the black image area is hatched and the colourless image area is left blank. Element 2 represents now a multicolor photographic element having three differently spectrally sensitive negative working silver halide emulsion layers viz. a blue-sensitive silver halide emulsion layer 3, a green-sensitive silver halide emulsion layer 4, and a red-sensitive silver halide emulsion layer 5 applied to a support 6.

The blue-, green- and red-sensitive silver halide emulsion layers contain respectively a yellow, magenta and cyan coloured azo dye compound according to the general formula (2) which compounds on reduction and under alkaline conditions split off a yellow (Y), magenta (M) and cyan (C) azo dye moiety respectively.

In the area not struck by light i.e. the area of the photographic material 2 corresponding with the black (hatched) area of the original 1 reducing agent(s) is (are) not used up in the reduction of exposed silver halide in the negative working silver halide emulsion layers so that by their reaction with the dye releasing compounds under alkaline conditions yellow, magenta and cyan dye moieties indicated by Y, M and C are split off to form superposition a black image area on the receptor material (not shown in the drawing).

The higher amount of reducing agent left in the non-exposed area makes that the reduction of the azo groups in the dyes present in these area occurs before the hydrolytic cleavage of the acyl group

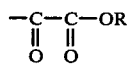

restoring the —OH auxochrome has taken place.

The reason why the oxalyl-monoester acylation is chosen over other acryl groups is due to the fact that the oxalyl-monoester group by its stronger electron-withdrawing character i.e. higher electronegativity than e.g. prior art acetyl or propionyl groups proved to enhance the reducibility of the azo group which group is far less reducible once the auxochromic hydroxyl group is regained by hydrolytic removal of the acyl group.

In the exposed area of the red-sensitive, green-sensitive and blue-sensitive silver halide emulsion layers (the hatched area) reducing agent is partly used up and also some alkali whereby the pH drops. As a result thereof the azo-groups of the dyes present in the exposed silver halide emulsion layer area are practically left unaffected. Such results in a higher transfer of dye in the receptor element in correspondence with the one-third spectrum colour parts than in the black image parts which means that a positive interimage effect is obtained. The positive interimage effect results in a multicolor image with higher colour saturation i.e. more brightness due to the fact that the black image area are less or no longer dominating.

The advantage is particularly important when the development proceeds in the presence of a silver halide solvent forming an alkali-soluble and reducible silver complex compound. Indeed, as described in the published EUR patent application no. 0049002 filed July 8, 1981 by Agfa-Gevaert N. V., the silver halide from the unexposed portions of the negative working silver halide emulsion layers is complexed with the silver halide solvent and is reduced by physical development at the site of the already formed silver image. Such is the case for example in the hatched area of layer 4 under the green (G) area of the original. Hereby magenta dye M which could leave that area by reaction with developing agent is not set free because developing agent is more rapidly used up by the combined chemical and physical development than by the chemical development alone. Consequently in that area non-oxidized developing agent(s) is (are) no longer available for reduction of the magenta dye providing compound.

The retaining of magenta dye in that area makes that a more brilliant green i.e. less greyish green is obtained in the receptor material for only yellow and cyan are superposed to reproduce green.

In a preferred embodiment the material of the present invention is developed with a mixture of reducing agents at least one of which is a compound called "electron donor" (ED-compound) and at least one of which is a compound called "electron-transfer agent" (ETA-compound). The electron-transfer agent is a compound which is a better silver halide reducing agent under alkaline conditions of processing than the electron donor. In those instances where the electron donor is incapable of, or substantially ineffective in developing the silver halide, the ETA-compound functions to develop the silver halide and provides a corresponding image-wise pattern of oxidized electron donor because the oxidized ETA-compound readily accepts electrons from the ED-compound. In unoxidized form the ED-compounds are capable of reducing said non-diffusing dye providing compound in alkaline medium.

The ED-compound is preferably present in non-diffusible state in each silver halide emulsion layer whereas the ETA-compound is used in diffusible form and can be present in the processing liquid or in one or more hydrophilic colloid layers of the photographic material.

In this way the reactions are better separated in their desired sequence in that first the image-wise oxidation of the ETA-compound by the exposed silver halide starts, then the rapid electron transfer to oxidized ETA-compound from the ED-compound takes place, which ED-compound being the less reactive compound where unaffected finally reacts with the dye providing compound to release its dye moiety.

Examples of ED-compounds are ascorbyl palmitate and 2,5-bis(1',1',3',3'-tetramethylbutyl)-hydroquinone and 2-octadecyl-5-sulphohydroquinone. Other ED-compounds are disclosed in U.S. Pat. No. 4,139,379, already mentioned hereinbefore and in the published German Patent Application No. 2,947,425 filed Nov. 24, 1979 by Agfa-Gevaert A. G. ED-precursor compounds are disclosed in the published German Patent Application 3,006,268 filed Feb. 20, 1979 by Agfa-Gevaert A. G. and correspond to the following general formula:

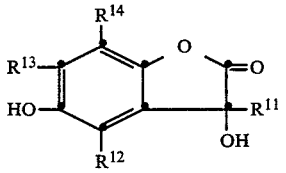

wherein:

$R^{11}$ represents a carbocyclic or heterocyclic aromatic ring, $R^{12}$, $R^{13}$ and $R^{14}$ (same or different) represent hydrogen, alkyl, alkenyl, aryl, alkoxy, alkylthio, amino, or $R^{13}$ and $R^{14}$ represent together an adjacent ring e.g. carbocyclic ring, and wherein at least one of $R^{11}$, $R^{12}$, $R^{13}$ and $R^{14}$ represent a ballast group having from 10–22 cabon atoms.

Typically useful ETA-compounds also diffusing in oxidized state are 3-pyrazolidinone compounds e.g. 1-phenyl-3-pyrazolidinone and 1-phenyl-4,4-dimethyl-3-pyrazolidinone.

A combination of different ETA's such as those disclosed in U.S. Pat. No. 3,039,869 of Howard G. Rogers and Harriet W. Lutes, issued June 19, 1962, can also be employed. Such developing agents can be employed in the liquid processing composition or may be contained, at least in part, in any layer or layers of the photographic element or film unit such as the silver halide emulsion layers, the dye image-providing material layers, interlayers, image-receiving layer, etc. The particular ETA-compound selected will, of course, depend on the particular electron donor and dye-providing compound used in the process and the processing conditions for the particular photographic element.

The concentration of ED-compound in the photographic material may vary within a broad range but is, e.g., in the molar range of 1:2 to 4:1 with respect to the non-diffusing dye or dye precursor compound. The ETA-compound may be present in the alkaline aqueous liquid used in the development step, but is used preferably in diffusible form in non-photosensitive hydrophilic colloid layers adjacent to at least one silver halide emulsion layer. The concentration of the ETA-compound in the photographic material is preferably in the same molar range as wherein the ED-compound is applied.

Migration of non-oxidized developing agent, e.g. acting as ETA-compound, proceeds non-image-wise and will have an adverse effect on correct colour rendering when surplus developing agent remains unoxidized in the photoexposed area of a negative working emulsion layer. Thereafter, according to an already mentioned embodiment of the present invention a silver halide solvent is used to mobilize unexposed silver halide in complexed form for helping to neutralize (i.e. oxidize by physical development) migrated developing agent in the photoexposed area wherein unaffected developing agent (ETA-compound) should no longer be available for reacting with the dye-providing compound directly or through the applied ED-compound.

As is known to those skilled in the art of silver halide photography, a considerable number of compounds form alkali-soluble complexes with silver ions. Among the many silver halide solvents may be mentioned thiosulphates, thiocyanates, thiosugars, thioetheracids e.g. $HOOC—(CH_2—S—CH_2)_3—COOH$ or an active methylene compound having the methylene group linked directly to sulphonyl groups as e.g. in $H_3C—SO_2—CH_2—SO_2—CH_3$. Preferably used are, however, water-soluble thiosulphates (particularly alkali metal thiosulphate or ammonium thiosulphate).

According to one embodiment the silver halide solvent acting as silver-ion-complexing agent is applied in the alkaline aqueous liquid that is used in the development step. A useful concentration of silver halide solvent, e.g. sodium thiosulphate, in said liquid is in the range of 0.1 g to 40 g per liter.

According to a special embodiment the complexing agent is set free in the presence of alkali from a precursor compound present in the photographic material during development. Precursor compounds, which in the presence of alkali release a diffusible photographic reagent such as a silver halide solvent, are described in the U.S. Pat. No. 3,698,898 by J. Michael Grasshoff and Lloyd D. Taylor, issued Oct. 17, 1972. Such precursor compounds, which in the presence of alkali are capable of splitting off a silver halide solvent compound, corresond to the following general formula:

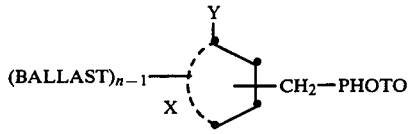

wherein

X represents the atoms necessary to complete a benzene or naphthalene nucleus,

Y is hydroxy or a substituent that upon hydrolysis provides hydroxy,

PHOTO represents a silver halide solvent moiety, e.g. a —S—$SO_3M$ group wherein M is an alkali metal or onium group, e.g. ammonium group, BALLAST is a ballasting group rendering said compound less diffusible in a water-permeated hydrophilic colloid layer that in would be without said group, and n is 1 or 2.

According to an embodiment said precursor compound is incorporated in the receiving layer of the receptor material wherefrom it can reach the contacting photoexposed photographic multilayer multicolour material upon alkaline treatment. According to another embodiment said precursor compound is incorporated in the photographic material, e.g. in the layer also containing diffusible developing agent (ETA-compound) and/or in the silver halide emulsion layers themselves. The rate of release of the silver halide solvent may be controlled by selection of the appropriate Y substituent, e.g. in the form of an ester group, which hydrolyses more or less rapidly. In the —$CH_2$— group of the above general formula one or both of the hydrogen atoms may be substituted by a hydrocarbon group, e.g. an alkyl group such as methyl or ethyl.

The photosensitive silver halide in the silver halide emulsion layers used in the process of the present invention is preferably a silver halide of the group of silver chloride, silver bromide, silver bromoiodide, silver chlorobromoiodide and the like, or mixtures thereof. The emulsions may be coarse- or fine-grain and can be prepared by any of the well-known procedures, e.g., single-jet emulsions, double-jet emulsions. They may be Lippmann emulsions, ammoniacal emulsions, thiocyanate- or thioether-ripened emulsions such as those described in U.S. Pat. Nos. 2,222,264 of Adolph H. Nietz and Frederick J. Russell, issued Nov. 19, 1940, 3,320,069 of Bernard D. Illingsworth, issued May 16, 1967, and 3,271,157 of Clarence E. McBride, issued Sept. 6, 1966. Surface-image emulsions or internal-image emulsions may be used such as thoe described in U.S. Pat. Nos. 2,592,250 of Edward Philip Davey and Edward Bowes Knott, issued Apr. 8, 1952, 3,206,313 of Henry D. Porter, Thomas H. James and Wesley G. Lowe, issued Sept. 14, 1965, and 3,447,927 of Robert E. Bacon and Jean F. Barbier, issued June 3, 1969. The emulsions may be regular-grain emulsions such as the type described by Klein and Moisar in J.Photogr.Sci., Vol. 12, No. 5, Sept./Oct., 1964, pp. 242–251. If desired, mixtures of surface- and internal-image emulsions may be used as described in U.S. Pat. No. 2,996,382 of George W. Luckey and John C. Hoppe, issued Aug. 15, 1961.

Further details about emulsion composition, preparation and coating are described, e.g. in Product Licensing Index, Vol. 92, December 1971, publication 9232, p. 107–109.

Generally speaking, the silver halide emulsion layers in the invention comprise photosensitive silver halide dispersed in gelatin and are about 0.2 to 2 μm thick. Preferably the dye image-providing materials are dispersed in negative working emulsions.

The negative emulsions can be chemically sensitized, e.g. by adding sulphur-containing compounds, e.g. allyl isothiocyanate, allyl thiourea, sodium thiosulphate and the like, during the chemical ripening stage. Also reducing agents, e.g. the tin compounds described in the Belgian Patent Specification Nos. 493,464 filed Jan. 24, 1950 and 568,687 filed June 18, 1958, both by Gevaert Photo-Producten N.V., and polyamines such as diethylenetriamine or derivatives of aminomethanesulphonic acid, e.g. according to the Belgian Patent Specification No. 547,323 filed Apr. 26, 1956 by Gevaert Photo-Producten N.V., can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z.Wiss.Photogr.Photophys.-Photochem. 46, 65–72 (1951).

Further it is possible to sensitize the emulsions with polyalkylene oxide derivatives, e.g. with polyethylene oxide having a molecular weight between 1000 and 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. For obtaining special effects these sensitizers of course can be combined with each other as described in Belgian Patent Specification No. 537,278 filed Apr. 12, 1955 and UK Patent Specification No. 727,982 filed Feb. 5, 1952, both by Gevaert Photo-Producten N.V.

The emulsions can be spectrally sensitized, e.g. by the usual mono- or polymethine dyes such as acidic or basic cyanines, hemicyanines, oxonols, hemioxonols, styryl dyes or others, also trior polynuclear methine dyes, e.g. rhodacyanines or neocyanines. Such sensitizers are described, e.g., by F. M. HAMER in "The Cyanine Dyes and Related Compounds" (1964) Interscience Publishers, John Wiley & Sons, New York.

The negative emulsions may contain the usual stabilizers such as, e.g., homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxyl or amino groups. Compounds of this kind are described by BIRR in Z.Wiss.Photogr.Photophys.Photochem. 47, 2–27 (1952). Still other suitable sensitizers are among others heterocyclic mercapto compounds, e.g. phenylmercaptotetrazole, quaternary benzothiazole derivatives, benzotriazole and the like.

As binding agent for the photographic layers preferably gelatin is used. However, it can be replaced wholly or partially by other natural or synthetic binding agents. Examples of natural binding agents are alginic acid and its derivatives such as salts, esters and amides, cellulose derivatives such as carboxymethylcellulose, alkylcellulose such as hydroxyethylcellulose, starch and its derivatives such as ethers or esters, or carragenates. Examples of synthetic binding agents are polyvinyl alcohol, partially saponified polyvinyl acetate, polyvinylpyrrolidone and the like.

Hardening of the layers can occur in the usual way, e.g. with formaldehyde or halogenated aldehydes containing a carboxyl group such as mucobromic acid, diketones, methanesulphonic acid esters, dialdehydes.

For carrying out the dye diffusion transfer process according to the present invention preferably a two-sheet system is used, which consists of a photographic material as described and of a separate image-receiving material wherein the desired colour image is produced by the image-wise transferred diffusing dyes. For that purpose a firm contact between the photographic material and the image-receiving material is necessary for a finite period of time during development. In this way the produced image-wise distribution of diffusing dyes produced in the photographic material as a result of development can be transferred to the image-receiving material. The contact is made after the development has been started.

For carrying out the dye diffusion transfer process also a material can be used wherein the light-sensitive element and the image-receiving element form an integral unit; it is also called a one-sheet material. A separation of the light-sensitive element from the image-receiving element after terminating the process of development, even after the dye transfer, is not necessary. Such an embodiment is described, e.g., in the published German Patent Application No. 2,019,430 filed Apr. 22, 1970 by Agfa-Gevaert A. G.

The support for the photographic elements used in this invention may be any material as long as it does not deleteriously affect the photographic properties of the film unit and is dimensionally stable. Typical flexible sheet materials are paper supports, e.g. coated at one or both sides with an α-olefin polymer, e.g. polyethylene, or film supports, e.g. cellulose nitrate film, cellulose acetate film, poly(vinyl acetal) film, polystyrene film, poly(ethylene terephthalate) film, polycarbonate film, poly-α-olefins such as polyethylene and polypropylene film, and related films of resinous materials. The support is usually about 0.05 to 0.15 mm thick.

In a photographic material for use according to the invention and containing two or more silver halide emulsion layers, each silver halide emulsion layer containing a dye-providing compound or having the dye image-providing compound present in a contiguous layer may be separated from the other silver halide emulsion layer(s) in the film unit by (an) interlayer(s), including e.g. gelatin, calcium alginate, or any of the colloids disclosed in U.S. Pat. No. 3,384,483 of Richard W. Becker, issued May 21, 1968, polymeric materials such as polyvinylamides as disclosed in U.S. Pat. No. 3,421,892 of Lloyd D. Taylor, issued Jan 14, 1969, or any of those disclosed in French Patent Specification No. 2,028,236 filed Jan. 13, 1970 by Polaroid Corporation or U.S. Pat. Nos. 2,992,104 of Howard C. Haas, issued July 11, 1961 and 3,427,158 of David P. Carlson and Jerome L. Reid, issued Feb. 11, 1969.

The interlayers are permeable to alkaline solutions, and are 1 to 5 μm thick. Of course these thicknesses are approximate only and may be modified according to the product desired.

According to an embodiment for correct spectral exposure of a multicolour dye diffusion transfer material for use according to the present invention, a water-permeable colloid interlayer dyed with a yellow non-diffusing dye is applied below the blue-sensitive silver halide emulsion layer containing a yellow dye-releasing compound and a water-permeable colloid interlayer dyed with a magenta non-diffusing dye is applied below the green-sensitive silver halide emulsion layer containing the magenta dye-releasing compound.

The image-receiving material used in this invention has the desired function of mordanting or otherwise fixing the dye images transferred from the photosensitive element. The particular material chosen will, of course, depend upon the dye to be mordanted. If acid dyes are to be mordanted, the image-receiving layer can be composed of, or contain basic polymer mordants such as polymers of aminoguanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, the compounds described in the published German Patent Application No. 2,200,063 filed Jan. 11, 1971 by Agfa-Gevaert A. G. Suitable mordanting binders include, e.g. guanylhydrazone derivatives of acyl styrene polymers, as described, e.g., in published German Patent Specification No. 2,009,498 filed Feb. 28, 1970 by Agfa-Gevaert A G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solutions, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkylphenols, etc.

According to a particular embodiment the photosensitive material is made suitable for in-camera processing. Therefor the receiving layer is integral with the photographic material and is arranged in water-permeable relationship with the silver halide hydrophilic colloid emulsion layers. For that purpose the photosensitive silver halide emulsion layers are applied to the same support as the receptor layer so as to form an integral combination of light-sensitive layer(s) and a non light-sensitive layer receiver element preferably with an opaque layer, which is alkali-permeable, reflective to light and located between the receptor layer and the set of silver halide emulsion layers. In a process using such material the alkaline processing composition may be applied between the outer photosensitive layer of the photographic element and a cover sheet, which may be transparent and superposed before exposure.

An alkaline processing composition employed in this invention may be a conventional aqueous solution of an alkaline material, e.g. sodium hydroxide, sodium carbonate or an amine such as diethylamine. Independent from the use of the silver halide solvent or in admixture therewith improved dye densities are obtained in the dye diffusion transfer process applying IHR-compounds when the alkaline processing liquid contains a saturated, aliphatic or alicyclic amino alcohol having from 2 to 10 carbon atoms and at least two hydroxy groups. Particularly high dye densities are obtained when using in said processing liquid triisopropanolamine. Other suitable dye density improving solvents, optionally used in admixture, are dimethylformamide, N-methyl-2-pyrrolidone and an aliphatic or cycloaliphatic hydroxy compound being e.g. a mono-alcohol, diol or triol that is not completely miscible with water at 20° C. Preferred examples thereof are n-butanol, isobutanol, 2,2-diethyl-propane-1,3-diol, 1-phenylethane-1,2-diol (styrene glycol), 2,2,4,4-tetramethylbutane-1,3-diol, 2-ethyl-hexane-1,3-diol and 1,4-cyclohexane-dimethanol.

Preferably the pH of the processing composition is at least 11. The processing composition may contain the above defined silver halide solvent compound. The latter may be contained in a silver halide solvent precursor compound applied in the photographic material and/or receptor material.

According to one embodiment the alkaline processing liquid contains a diffusible developing agent e.g. ascorbic acid or a 3-pyrazolidinone developing agent such as 1-phenyl-4-methyl-3-pyrazolidinone serving e.g. as ETA-compound for effecting the reduction of the exposed and complexed silver halide.

Processing of separatable photographic material and dye-receiving material may proceed in a tray developing unit as is present, e.g. in an ordinary silver complex diffusion transfer (DTR) apparatus in which contacting with the separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp-/Leverkusen.

According to the other embodiments wherein the receptor layer is integral with the photosensitive layer(s) the processing liquid is applied e.g. from a rupturable container or by spraying.

The rupturable container may be of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general such containers comprise a rectangular sheet of fluid- and air-impervious material folded longitudinally upon itself to form two walls that are sealed to one another along their longitudinal and end margins to form a cavity in which processing solution is contained.

The following comparative examples illustrate and confirm the possibility to obtain a useful interimage effect with a present photographic material of the present invention. All percentages and ratios are by weight, unless otherwise mentioned, and the amounts expressed per sq.m.

EXAMPLE 1

Preparation of comparative photographic material I

A subbed polyethylene terephthalate support having a thickness of 0.1 mm was coated in the mentioned order with the following layers:

| | | |
|---|---|---|
| (1) | a red-sensitive silver halide emulsion layer containing: | |
| | gelatin | 1.5 g |
| | red-sensitised AgCl expressed as $AgNO_3$ | 0.5 g |
| | cyan dye-providing quinonoid compound C | 0.267 g |
| | ED-compound 1: | |
| | 2,5-bis(1',1',3',3'-tetramethylbutyl)-hydroquinone | 0.115 g |
| (2) | an interlayer containing: | |
| | gelatin | 1.3 g |
| | ED-compound 2: | |
| | 2-octadecyl-hydroquinone-5-sulphonic acid potassium salt | 0.12 g |
| | a red filter dye | |
| (3) | a green-sensitive silver halide emulsion layer containing: | |
| | gelatin | 1.5 g |
| | green-sensitized AgCl expressed as $AgNO_3$ | 0.5 g |
| | magenta dye-providing compound M | 0.222 g |
| | 2,5-bis(1',1',3',3'-tetramethylbutyl)-hydroquinone | 0.10 g |
| (4) | an interlayer containing: | |
| | gelatin | 1.15 g |
| | 2-octadecyl-hydroquinone-5-sulphonic acid potassium salt | 0.12 g |
| | 1-phenyl-4-methyl-pyrazolidin-3-one | 0.08 g |
| | a yellow filter dye | |
| (5) | a blue-sensitive silver halide emulsion layer containing: | 1.4 g |
| | gelatin | |
| | blue-sensitive AgCl expressed as $AgNO_3$ | 0.5 g |
| | yellow dye-providing compound Y | 0.465 g |
| (6) | protective layer containing: | |
| | gelatin | 1.4 g |
| | 1-phenyl-4-methyl-pyrazolidin-4-one | 0.15 g |
| | citric acid up to a pH of 4.5 in the six layers | 0.15 g |

The dye providing compounds M and Y have been prepared as described in the published European Patent Application No. 00 38 092 and dye providing compound C has been prepared in analogy to procedures described in the published European Patent Application 00 04 399.

Structure of compound C:

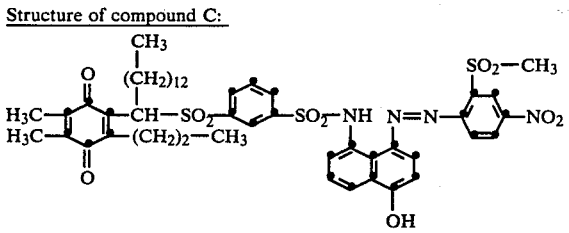

Structure of compound M:

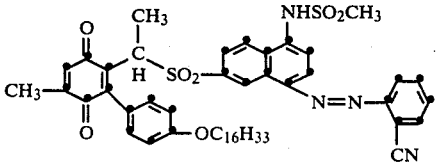

Structure of compound Y:

-continued

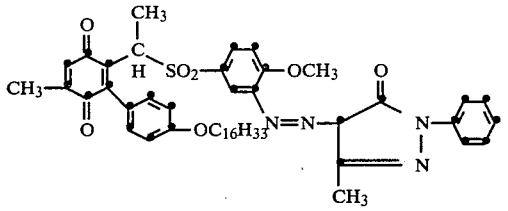

EXAMPLE 2

Preparation of photographic material II according to the present invention.

The preparation of Example 1 was repeated, with the difference however, that the red-sensitive silver halide emulsion contained 0.295 g of acylated cyan dye-providing quinonoid compound C1 prepared as described hereinafter.

EXAMPLE 3

Preparation of photographic material III according to the present invention.

The preparation of Example 2 was repeated, with the difference however, that the red-sensitive silver halide emulsion layer contained 0.230 g of the ED-compound 1.

EXAMPLE 4

Preparation of photographic material IV according to the present invention.

The preparation of Example 2 was repeated with the difference however, that ED-compound 1 was replaced by 0.190 g of ED-compound 3 having the following structural formula:

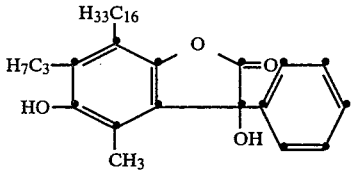

EXAMPLE 5

Preparation of photographic material V according to the present invention.

The preparation of Example 4 was repeated, with the difference however, that ED-compound 3 was applied in an amount of 0.380 g.

EXAMPLE 6

Preparation of photographic material VI according to the present invention.

The preparation of Example 2 was repeated with the difference however, that the red-sensitive silver halide emulsion layer contained instead of compound C1 0.300 g of acylated cyan dye-providing compound C2 prepared as described hereinafter.

EXAMPLE 7

Preparation of comparative photographic material VII.

The preparation of Example 1 was repeated, with the difference however, that the compound C was replaced by 0.270 g of cyan dye-providing compound C3 prepared in analogy to procedures described in the European Patent Application No. 83 201 506.9 titled "Diffusion transfer material and process" filed on Oct. 20, 1983.

Structure of compound C3:

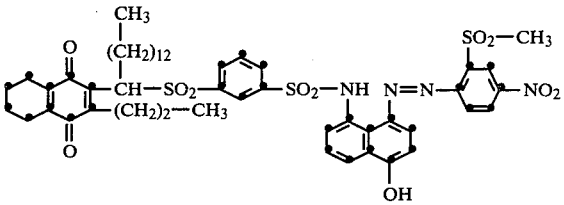

EXAMPLE 8

Preparation of photographic material VIII according to the present invention.

The preparation of Example 7 was repeated, with the difference however, that the compound C3 was replaced by 0.300 g of acylated cyan dye-providing compound C4 prepared as described hereinafter.

EXAMPLE 9

Preparation of comparative photographic material IX.

The preparation of Example 1 was repeated, with the difference however, that compound M was replaced by 0.248 g of magenta dye-providing compound M1 prepared as described in the published European Patent Application 00 38 092.

Structure of compound M1:

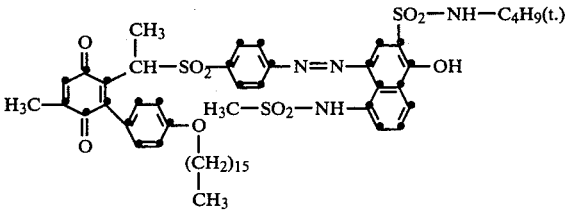

EXAMPLE 10

Preparation of photographic material X according to the present invention.

The preparation of Example 9 was repeated, with the difference however, that the compound M1 was replaced by 0.275 g of acylated magenta dye-providing compound M2 prepared by acylating compound M1 with ethyl oxalyl chloride in analogy to the preparation of compound C1 as described in the published European Patent Application 00 38 092.

Structure of compound M2:

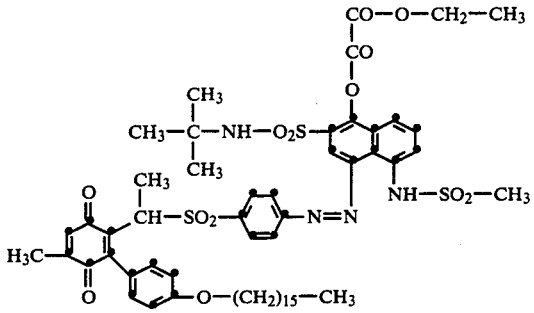

EXAMPLE 11

Preparation of comparative photographic material XI.

The preparation of Example 1 was repeated, with the difference however, that the red-sensitive silver halide emulsion layer contained 0.282 g of an acylated cyan dye-providing quinonoid compound C5 compound prepared as described hereinafter and 0.104 g of the already mentioned ED-compound 1.

EXAMPLE 12

Preparation of comparative photographic material XII.

The preparation of Example 11 was repeated, with the difference however, that the red-sensitive silver halide emulsion layer contained 0.208 g of ED-compound 1.

The above materials I to XII were exposed through colour filters to obtain blue, green, red, cyan, magenta, yellow and black image parts.

The processing was carried out in a COPYPROOF (registered trade name of Agfa-Gevaert N. V. Belgium) T42 diffusion transfer processing apparatus containing in its tray an aqueous solution comprising per liter:

| | |
|---|---|
| sodium hydroxide | 25 g |
| sodium orthophosphate | 25 g |
| cyclohexane dimethanol | 80 g |
| sodium bromide | 2 g |
| sodium thiosulfate | 2 g |
| water up to | 1 liter. |

After being wetted at room temperature (20° C.) with said solution the exposed photographic materials were contacted for 1 min with the receptor material as described hereinafter to allow the diffusion transfer of the dyes. After separating the photographic materials from the receptor material dye transfer was measured with a MACBETH (trade name) densitometer RD-100R behind a Kodak Wratten filter No. 25 (red), 58 (green) and 47 (blue) respectively.

The Wratten filter No. 25 manufactured by The Eastman Kodak Company has a percent transmittance as represented on page E-218 of the Handbook of Chemistry and Physics, 52nd Edition, Editor Robert C. West-CRC Press 18901 Cranwood Parkway, Cleveland, Ohio 44128, U.S.A. The Wratten filters 58 and 47 have a percent transmittance as mentioned on page E-219 of said book.

Preparation of dye receptor material

To a corona-treated polyethylene coated paper support a coating having the following composition was applied per sq.m:

| | |
|---|---|
| gelatin | 5 g |
| triphenyl-n-hexadecylphosphonium bromide | 2 g |

Measurement results

Red light absorption ($D_{R1}$) in the maximum density parts of the cyan wedge print obtained with materials I to VIII and XI and XII.

| Material | I | II | III | IV | V | VI | VII | VIII | XI | XII |
|---|---|---|---|---|---|---|---|---|---|---|
| $D_{R1}$ | 158 | 170 | 185 | 155 | 187 | 128 | 167 | 118 | 102 | 150 |

Green light absorption ($D_{G1}$) in the magenta wedge print parts of materials IX and X.

| Material | IX | X |
|---|---|---|
| $D_{G1}$ | 97 | 71 |

Red light absorption ($D_{R2}$) in the maximum density parts of the red wedge print obtained with materials I to VIII and XI and XII.

| Material | I | II | III | IV | V | VI | VII | VIII | XI | XII |
|---|---|---|---|---|---|---|---|---|---|---|
| $D_{R2}$ | 31 | 30 | 30 | 30 | 30 | 34 | 33 | 33 | 32 | 32 |

Green light absorption ($D_{G2}$) in the green wedge print parts of materials IX and X.

| Material | IX | X |
|---|---|---|
| $D_{G2}$ | 58 | 59 |

To find out whether or not an interimage effect was obtained and to what degree, the density values $D_{R1}$ and $D_{R2}$ where added and compared with the red light absorption density ($D_{R3}$) measured in the black image parts of materials I to VIII and XI and XII.

| Material | I | II | III | IV | V | VI | VII | VIII | XI | XII |
|---|---|---|---|---|---|---|---|---|---|---|
| $D_{R3}$ | 183 | 124 | 108 | 156 | 155 | 107 | 190 | 106 | 164 | 184 |
| Material | IX | X | | | | | | | | |
| $D_{G3}$ | 142 | 113 | | | | | | | | |

A lower red light density $D_{R3}$ and $D_{R1}+D_{R2}$ corresponds with a positive interimage effect, which may be expressed in percent values by the equation:

$$\left(\frac{D_{R1} + D_{R2}}{D_{R3}} \times 100\right) - 100 = \%\ \text{interimage effect}$$

The results of said calculation for the materials I to VIII and XI and XII are expressed hereinafter in Table 1.

TABLE 1

| Material | % interimage effect |
|---|---|
| I | +3% |
| II | +61% |
| III | +99% |
| IV | +18% |
| V | +40% |
| VI | +51% |
| VII | +5% |
| VIII | +42% |
| XI | −18% |
| XII | −1% |

The same calculations were carried out with the $D_{G1}$, $D_{G2}$ and $D_{G3}$ values the results of which are listed in Table 2.

TABLE 1

| Material | % interimage effect |
|---|---|
| IX | +9% |
| X | +15% |

96.2 g (0.1 mole) of compound C were put into 250 ml of pyridine and whilst stirring at room temperature (20° C.) 11.2 ml (0.2 mole) of ethyl oxalyl chloride were added thereto. The temperature rose to about 35° C. Stirring was continued for 15 min and at once a further 11.2 ml (0.2 mole) of ethyl oxalyl chloride was added. The colour of the reaction mass turned from blue-green to orange. Stirring was still continued for about 1 minute and the reaction mixture poured briskly whilst stirring into a mixture of 2.5 l of water and 307 ml of concentrated hydrochloric acid. Stirring was continued up till the sticky precipitate became solid (about 30 to 60 minutes). The precipitate was separated by suction filtering and washed to neutral with water. After drying in a ventilated drying stove 106 g of compound C1 were obtained.

Preparation of compound C2

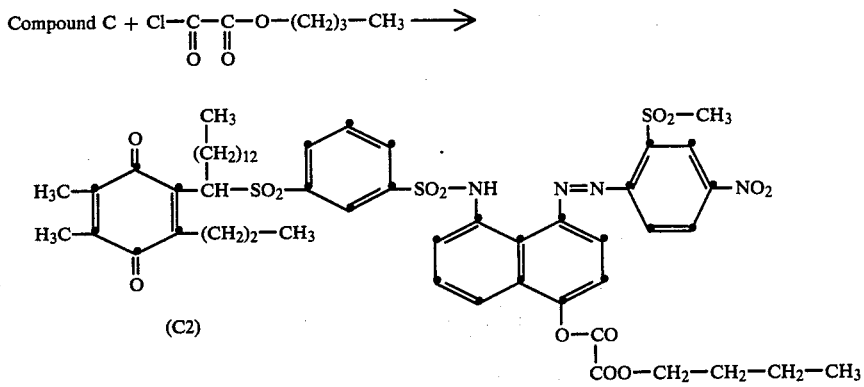

96.2 g (0.1 mole) of compound C were put into a mixture of 500 ml of dimethyl formamide and 45.4 ml (0.5 mole) of N-ethyl-diisopropyl amine. To the obtained solution 33 g (0.2 mole) of n-butyl oxalyl chloride were added at once at room temperature (20° C.) whilst stirring. Stirring was continued for still 30 minutes at room temperature, and thereupon the reaction mixture was poured into a mixture of 5 l of water and 614 ml of concentrated hydrochloric acid. The precipitated mass was stirred till solidification. Then the precipitate was separated by suction filtering and washed with water to neutral. After drying at room temperature in a ventilated drying stove 109 g of compound C2 were obtained.

Preparation of compound C1

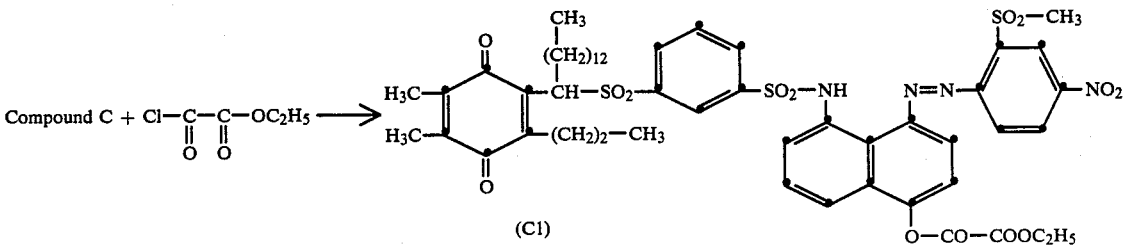

Preparation of compound C4

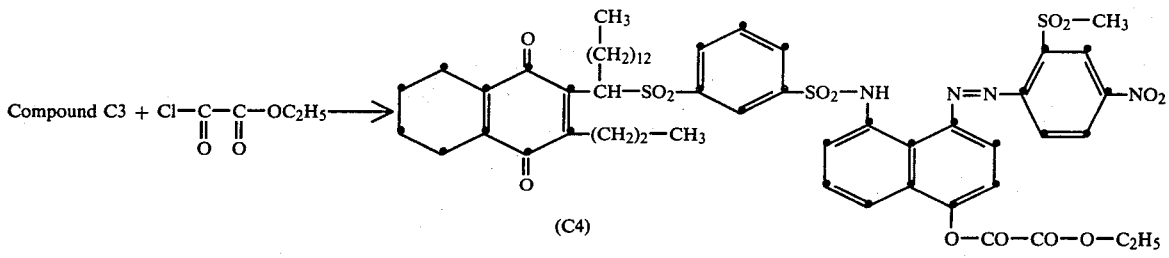

At room temperature (20° C.) 9.88 g (10 mmole) of compound C3 were stirred in 100 ml of pyridine. 6.7 ml (60 mmole) of ethyl oxalyl chloride were added dropwise in 30 minutes. Stirring was continued for 30 minutes and thereupon the reaction mixture was poured into a mixture of 1 l of water and 123 ml of concentrated hydrochloric acid. The precipitate was separated by suction filtering and washed till neutral with water.

After drying 12.3 g of compound C4 were obtained.

Preparation of compound C5:

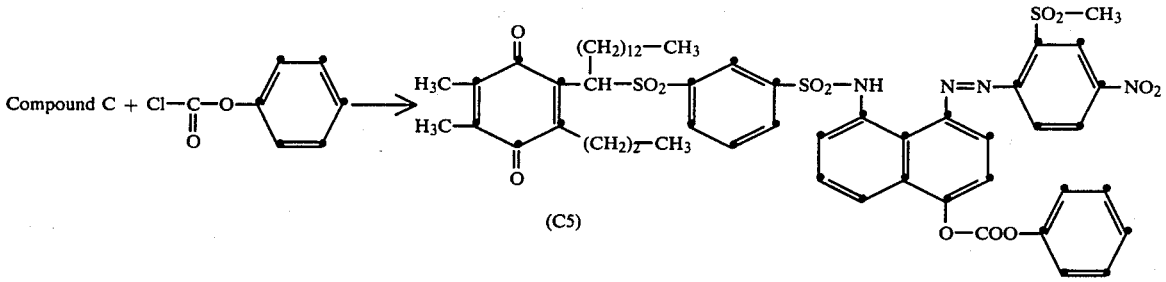

At room temperature (20° C.) 09.62 g (10 mmole) of compound C were stirred in 50 ml of acetone and 4.2 g (50 mmole) of $NaHCO_3$ were added. To the obtained mixture 1.28 ml (10 mmole) of phenyl chloroformate were added and stirring continued for 30 minutes. Thereupon a further 1.28 ml (10 mmole) of phenyl chloroformate were added and stirring continued for 30 minutes at 20° C. and finally for 30 minutes at 40° C.

The precipitated NaCl and surplus $NaHCO_3$ were removed by suction filtering and the filtrate was poured into 250 ml of water acidified with hydrochloric acid. After decantation and adding a fresh amount of water the oily precipitate was solidified, separated by suction filtering and dried. Yield: 11.3 g of compound C5.

We claim:

1. A photographic silver halide material comprising a support carrying at least one unexposed alkali-permeable silver halide hydrophilic colloid emulsion layer containing, or being in operable contact with a compound which is immobile in an alkali-permeable colloid medium when contacted with an alkaline liquid and which is capable of being reduced by a silver halide developing agent at a rate slower than that of the said silver halide when in developable state, and when in reduced state is capable of releasing a dye moiety, characterized in that said compound corresponds in reduced state to general formula (1) and in oxidized state to general formula (2):

$$A^1—L—P \quad (1)$$

$$A^2—L—P \quad (2)$$

wherein:

$A^1$ represents a hydroquinonyl group or such group that makes part of a fused ring system, $A^2$ represents a quinonyl group or such group that makes part of a fused ring system, L represents a bivalent group which undergoes a cleavage under hydrolytic alkaline conditions when the compound is in reduced state corresponding to formula (1), P represents an organic dye moiety incorporating an azo chromophoric group —N=N— linked through a conjugated bond system to an electron-withdrawing group being a monoester oxalyl group $$—O—\underset{\underset{O}{\|}}{C}—\underset{\underset{O}{\|}}{C}—OR,$$

wherein R represents an organic group that can be introduced by esterification of a carboxylic acid group, said monoester oxalyl group being removable by hydrolysis resulting in a residual auxochromic hydroxyl (—OH) group.

2. Photographic material according to claim 1, characterized in that R represents a $C_1$–$C_4$ alkyl group or a phenyl group.

3. Photographic material according to claim 1, characterized in that the dye providing compound is a ballasted compound capable of undergoing an electron-accepting nucleophilic displacement reaction in alkaline liquid whereby diffusible azo dye is separated.

4. Photographic material according to claim 1, characterized in that the dye providing compound is a ballasted compound capable of being split in an alkaline liquid into a ballasted quinone methide compound and a diffusible azo dye.

5. Photographic material according to claim 3, characterized in that L represents

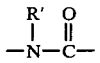

wherein R′ is hydrogen or a hydrocarbon group.

6. Photographic material according to claim 4, characterized in that L represents

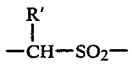

wherein R′ is hydrogen or a hydrocarbon group.

7. Photographic material according to claim 1, comprising a support carrying red-, green- and blue-sensitive negative working silver halide emulsion layers, each of said emulsion layers containing said compound that is initially immobile in an alkali-permeable colloid medium, and which is capable of releasing a cyan, magenta and yellow dye, respectively.

8. Photographic material according to claim 1, comprising one or more photosensitive silver halide emulsion layers, a supported non-light-sensitive receptor layer, and an alkali-permeable light-reflective opaque layer between and integral with said silver halide emulsion layers and said supported receptor layer.

9. Photographic material according to claim 1, characterized in that said compound is present in a hydrophilic colloid layer adjacent to a silver halide emulsion layer.

10. Photographic material according to claim 1, characterized in that said compound is used in the photographic material in conjunction with a mixture of reducing agents at least one of which is an ED-compound and at least one of which is an ETA-compound.

* * * * *